US006742338B2

(12) United States Patent
Tanaka et al.

(10) Patent No.: US 6,742,338 B2
(45) Date of Patent: Jun. 1, 2004

(54) GAS TURBINE COMBUSTOR

(75) Inventors: Katsunori Tanaka, Hyogo (JP); Teruaki Akamatsu, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 28 days.

(21) Appl. No.: 10/166,649

(22) Filed: Jun. 12, 2002

(65) Prior Publication Data

US 2002/0189258 A1 Dec. 19, 2002

(30) Foreign Application Priority Data

Jun. 13, 2001 (JP) ..... 2001-179320

(51) Int. Cl.[7] ..... F23R 3/30
(52) U.S. Cl. ..... 60/737; 60/746
(58) Field of Search ..... 60/737, 746, 747

(56) References Cited

U.S. PATENT DOCUMENTS 5,640,841 A 6/1997 Crosby
6,038,861 A 3/2000 Amos et al.
6,068,467 A 5/2000 Mandai et al.
6,082,111 A * 7/2000 Stokes ..... 60/737
6,460,339 B2 * 10/2002 Nishida et al. ..... 60/737
6,631,614 B2 * 10/2003 Mandai et al. ..... 60/737

FOREIGN PATENT DOCUMENTS

| | | |
|---|---|---|
| EP | 1 134 494 | 9/2001 |
| JP | 11-223341 | 8/1999 |
| JP | 2000-111556 | 4/2000 |

* cited by examiner

*Primary Examiner*—Michael Koczo
(74) *Attorney, Agent, or Firm*—Oblon, Spivak, McClelland, Maier & Neustadt, P.C.

(57) ABSTRACT

A combustor inner cylinder is disposed inside a combustor outer casing, and a spread flame formation cone and a plurality of premixed flame-formation nozzles are provided inside the combustor inner cylinder. The premixed flame-formation nozzles have sector-shaped outlets and disposed annularly between the combustor inner cylinder and the spread flame formation cone which forms spread combustion flames. Part of the air from a compressor is passed through clearances between the premixed flame-formation nozzles as cooled air and discharged toward a combustion chamber.

2 Claims, 8 Drawing Sheets

GAS TURBINE COMBUSTOR

FIELD OF THE INVENTION

This invention relates to a gas turbine combustor which can prevent the burning of premixed flame-formation nozzles by the back flow of a fuel gas.

BACKGROUND OF THE INVENTION

A diffuse combustion system, in which fuel and the air are ejected from different nozzles and burned, has been often used for conventional gas turbine combustors. Recently, however, a premix combustion system which is more advantageous in the reduction of thermal $NO_x$ has been also used in place of the diffuse combustion system. The premix combustion system means that fuel and the air are premixed with each other and the mixture is ejected from the same nozzle and burned. According to this combustion system, even if fuel is rarefied, it is possible to burn the fuel in that state in any combustion regions. Therefore, it is easy to decrease the temperature of the premixed fuel and advantageous in the reduction of $NO_x$ compared with the diffuse combustion system. On the other hand, this premix combustion system has the following problem. That is, since the air is excess compared with the fuel and the temperature of premixed flames is low, the stability of a combustion state is inferior.

Recently, there is known a technique which employs spread flames formed by reacting pilot fuel with the air, as pilot flames so as to solve the above-stated problem and to maintain a stable combustion state while the fuel is rarefied in the premix combustion system. Specifically, this technique is for igniting premixed gas using high-temperature combustion gas discharged from spread flames and stabilizing the premixed flames in the premix combustion system. A gas turbine combustor using this technique is referred to as multi-nozzle premix type gas turbine combustor.

FIG. 7 is a front view of a multi-nozzle premix type gas turbine combustor which has been conventionally used. In addition, a cross-section in an axial direction of the conventional gas turbine combustor is similar to the cross-section depicted in FIG. 8. However, the conventional premixed flame-forming nozzles 40 are used instead of premixed flame-forming nozzles 41. A combustor inner cylinder 20 is provided in a combustor outer casing 10 with a certain clearance kept between the combustor outer casing 10 and the combustor inner cylinder 20. A spread flame formation cone 30 which forms spread flames is provided on the central portion of the combustor inner cylinder 20. The spread flame formation cone 30 causes pilot fuel supplied from a pilot fuel supply nozzle 31 to react with the air supplied from the portion between the combustor outer casing 10 and the combustor inner cylinder 20 and forms spread flames.

Eight premixed-flame formation nozzles 40 which form premixed flames are provided around the spread flame formation cone 30. Premixed gas is formed by mixing the air supplied from the portion between the combustor outer casing 10 and the combustor inner cylinder 20 with main fuel and then ejected from the premixed flame-formation nozzles 40. The premixed gas ejected from the premixed flame-formation nozzles 40 is ignited by high-temperature combustion gas discharged from the spread flames to thereby form premixed flames. High-temperature, high-pressure combustion gas is discharged from the premixed flames. The combustion gas is passed through a combustor tail pipe (not shown) and then introduced into the first-stage nozzle of a turbine.

In the meantime, since the outlets of the conventional premixed flame-formation nozzles 40 are elliptical, the clearances between the adjacent premixed flame-formation nozzles 40 are not constant as shown in FIG. 7. Therefore, the high-temperature combustion gas discharged from the premixed flame flows back because of uneven air flows between the wide clearances and the narrow clearances. Portions on which the premixed flame-formation nozzles 40 are adjacent each other (the side surface portions of the premixed flame-formation nozzles 40 adjacent each other in the peripheral direction of the combustor inner cylinder 20) are, in particular, disadvantageously, greatly burned.

To avoid the burning, it may be possible to arrange the premixed flame-formation nozzles 40 to keep a certain distance from one another so as to prevent the combustion gas from flowing back. However, if the number of the nozzles arranged as stated above is small or many nozzles are to be arranged as stated above, the size of the combustor itself becomes disadvantageously large.

SUMMARY OF THE INVENTION

It is an object of this invention to provide a gas turbine combustor which can prevent the burning of premixed flame-formation nozzles due to the backflow of high-temperature combustion gas.

In the conventional gas turbine combustor, since the clearances between the outer peripheries of the adjacent premixed flame-formation nozzles are not constant, most of the cooled air flows out from the portions between the adjacent premix nozzles and the combustor inner cylinder and the like.

In the gas turbine combustor according to one aspect of the present invention, the nozzle outlet of the premixed flame-formation nozzles are shaped so that the clearances between the outer peripheries of the adjacent premixed flame-formation nozzles have same dimensions at the nozzle outlets. Therefore, the cooled air flows even into the portions between the adjacent premixed flame-formation nozzles. As a result, it is possible to suppress combustion gas from flowing back to the portions between the adjacent premixed flame-formation nozzles and to prevent the portions between the adjacent premixed flame-formation nozzles from being burned.

In the gas turbine combustor according to another aspect of the present invention, sealing members which are provided between the premixed flame-formation nozzles adjacent each other, respectively make the clearances between the premixed flame-formation nozzles adjacent each other have same dimensions at nozzle outlets. Therefore, the cooled air flows even into the portions between the adjacent premixed flame-formation nozzles, thereby making it possible to suppress the backflow of combustion gas into these portions. As a result, it is possible to prevent the portions between the adjacent premixed flame-formation nozzles from being burned.

In the gas turbine combustor according to still another aspect of the present invention, by providing the sealing members in the generally triangular spaces, clearances of almost same dimensions are generated between the outer peripheries of the premixed flame-formation nozzles. Therefore, most of the cooled air is passed through the clearances, so that it is possible to suppress combustion gas from flowing back to the portions between the adjacent premixed flame-formation nozzles and to prevent the portions between the adjacent premixed flame-formation nozzles from being burned.

In the gas turbine combustor according to still another aspect of the present invention, the inside of the combustor inner cylinder and the outside of the spread flame formation cone are shaped to be matched to the outer shape of the annular premixed flame-formation nozzle groups with same dimensions, respectively. Therefore, the cooled air evenly flows into the peripheries of the premixed flame-formation nozzles. It is, therefore, possible to suppress the backflow of combustion gas in the direction of the adjacent premixed flame-formation nozzles. As a result, it is possible to prevent the portions between the premixed flame-formation nozzles from being burned.

Other objects and features of this invention will become apparent from the following description with reference to the accompanying drawings.

DETAILED DESCRIPTIONS

Embodiments of the gas turbine combustor according to the present invention will be described hereinafter in detail with reference to the accompanying drawings. It is noted that this invention should not be limited to the following embodiments. It is also noted that constituent elements in the embodiments to be described below include those which a person skilled in the art can easily assume.

Figure 1:
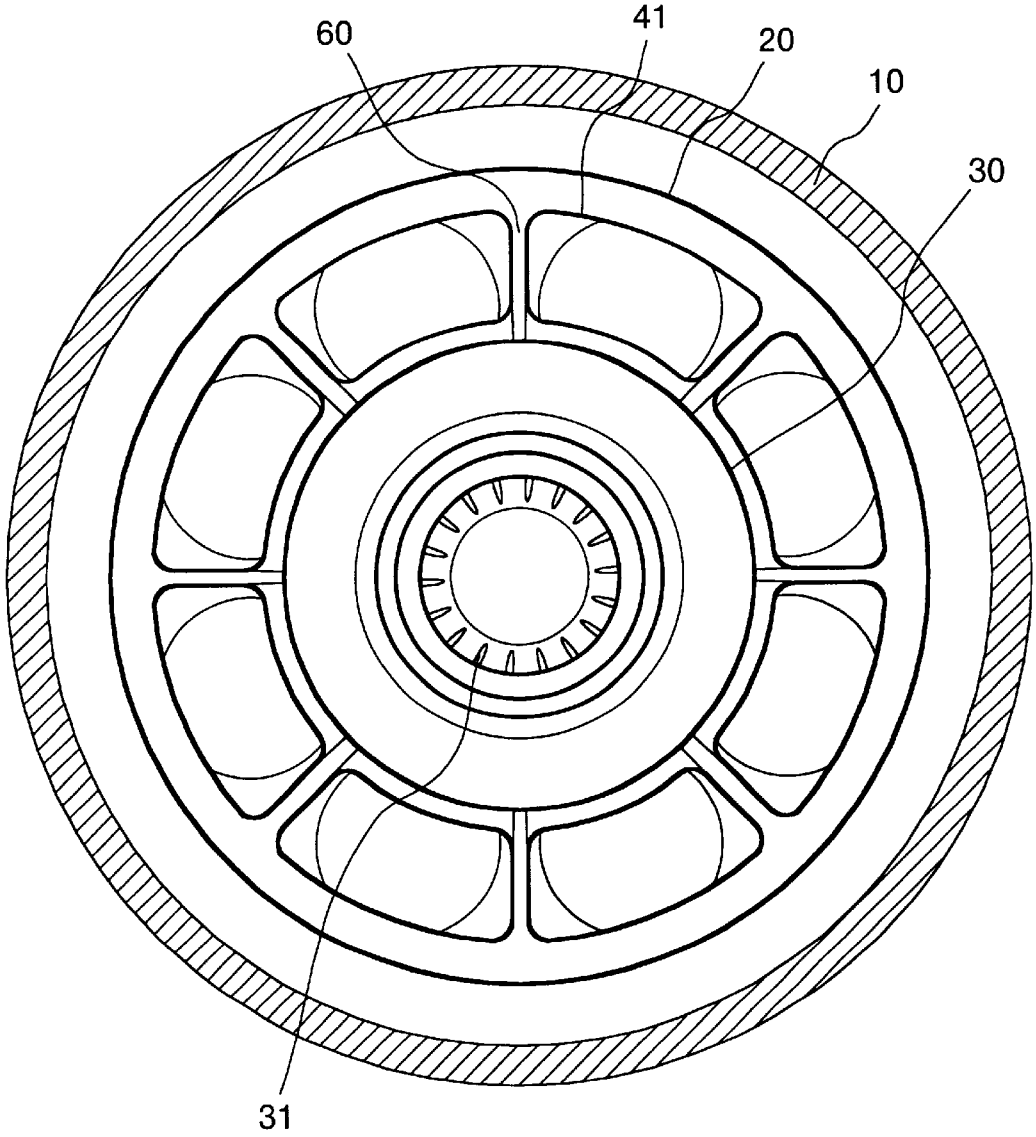
FIG. 1 is a front view of a gas turbine combustor according to a first embodiment of the invention.

FIG. 1 is a front view of the gas turbine combustor according to the first embodiment. It is noted that this invention is applicable to not only a case of directly ejecting premixed gas from premixed flame-formation nozzles toward a combustion chamber but also a case of providing extension tubes at the nozzles and ejecting premixed gas toward the combustion chamber.

A premixed flame-formation nozzle 41 according to this gas turbine combustor has a sector-shaped outlet to thereby keep the clearance 60 between adjacent premixed flame-formation nozzles 41 constant. Eight premixed flame-formation nozzles 41 are annularly disposed around a spread flame formation cone 30 which forms spread combustion flames. It is noted that the number of the premixed flame-formation nozzles 41 is not limited to eight but can be changed according to the specification of the combustor. In addition, it is preferable that the size of the clearance 60 is appropriately determined in view of the sizes and shapes of the premixed flame-formation nozzles 41, the spread flame formation cone 30 and the like.

In addition to keeping the sizes of the clearances between the outer peripheries of the outlets of the adjacent premixed flame-formation nozzles 41 constant, the sizes of at least either the clearances between the outer peripheral portions of the outlets of the premixed flame-formation nozzles 41 and the inner periphery of the outlet of the combustor inner cylinder 20 (or nozzle) or the clearances between the outer peripheral portions of the premixed flame-formation nozzles 41 and the inner periphery of the outlet of the spread flame formation cone 30 may be kept constant. If so, cooled air can evenly flow in more regions on the outer peripheries of the outlets of the premixed flame-formation nozzles 41 and the premixed flame-formation nozzles 41 can be entirely, uniformly cooled.

It is preferable that one of the clearance between the outer peripheral portions of the premixed flame-formation nozzles 41 and the inner periphery of the outlet of the combustor inner cylinder 20, the clearance between the outer peripheral portion of the premixed flame-formation nozzle 41 and the outer periphery of the outlet of the spread flame formation cone 30 and the clearance between the adjacent premixed flame-formation nozzles 41 is not extremely different in size from the other two clearances. This is because if one of the clearances extremely differs in size from the other two clearances, most of the cooled air flows through the clearances of the extremely different size or, conversely, the cooled air hardly flows through them.

Figure 8:
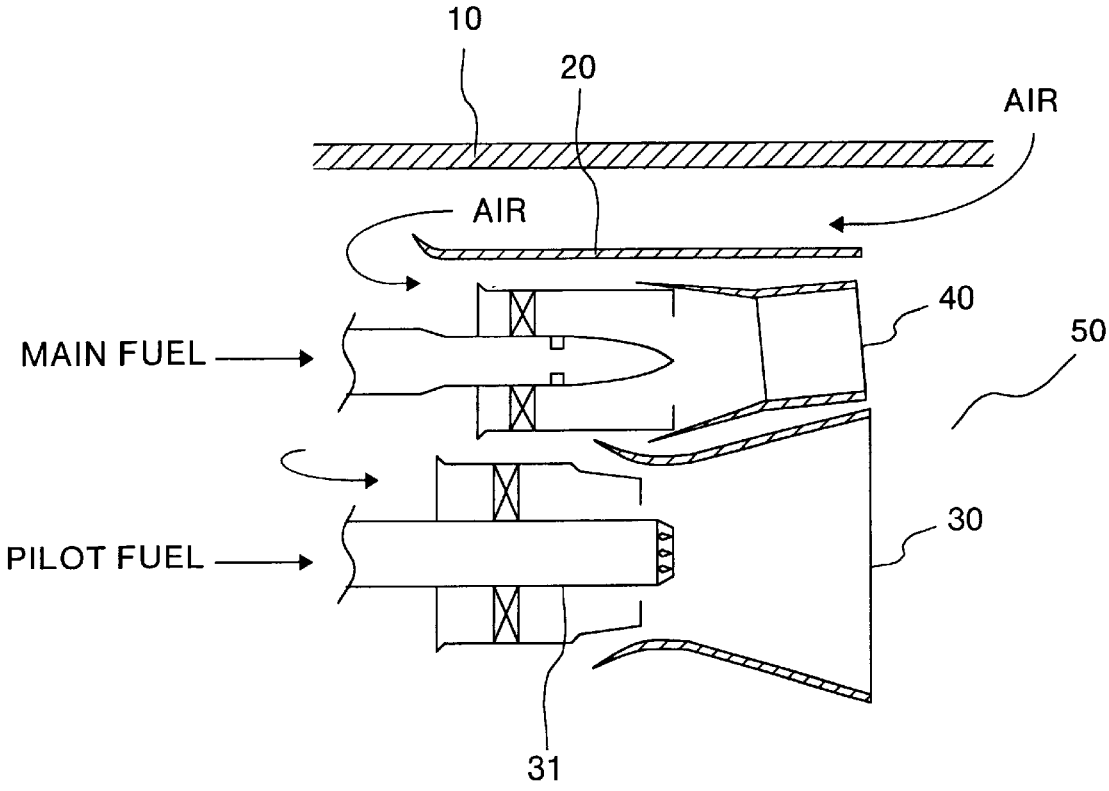
Prior Art FIG.8
FIG. 8 is a cross-sectional view of the gas turbine combustor shown in FIG. 7 taken in an axial direction.

This invention will next be described with reference to FIG. 8. The air fed from a compressor (not shown) is introduced into the combustor outer casing 10. After flowing between the combustor outer casing 10 and the combustor inner cylinder 20, the air changes its traveling direction by 180°. Thereafter, the air is fed into the premixed flame-formation nozzles 41 and the spread flame formation cone 30 from the rear side of the combustor inner cylinder 20 and mixed with main fuel and pilot fuel, respectively. In addition, part of the air is passed through the clearances between the combustor inner cylinder 20 and the premixed flame-formation nozzles 41 and between the premixed flame-formation nozzles 41 and the spread flame formation cone 30 and discharged toward the combustion chamber 50. During that time, the air cools the combustor inner cylinder 20, the premixed flame-formation nozzles 41 and the spread flame formation cone 30 and further prevents high-temperature combustion gas from flowing back from the combustion chamber 50 side.

The pilot fuel is reacted with the air fed from the compressor to form spread flames and the spread flames are ejected from the spread flame formation cone 30. In addition, the air is mixed with the main fuel in large quantities to thereby form premixed gas in the premixed flame-formation nozzles 41. This premixed gas is promptly ignited by high-temperature combustion gas discharged from the spread flames. Premixed flames are the n formed at the outlets of the premixed flame-formation nozzles 41 and high-temperature, high-pressure combustion gas is discharged from the premixed flames. The combustion gas is passed through a combustor tail pipe (not shown) and introduced into a first-stage nozzle of a turbine.

Figure 7:
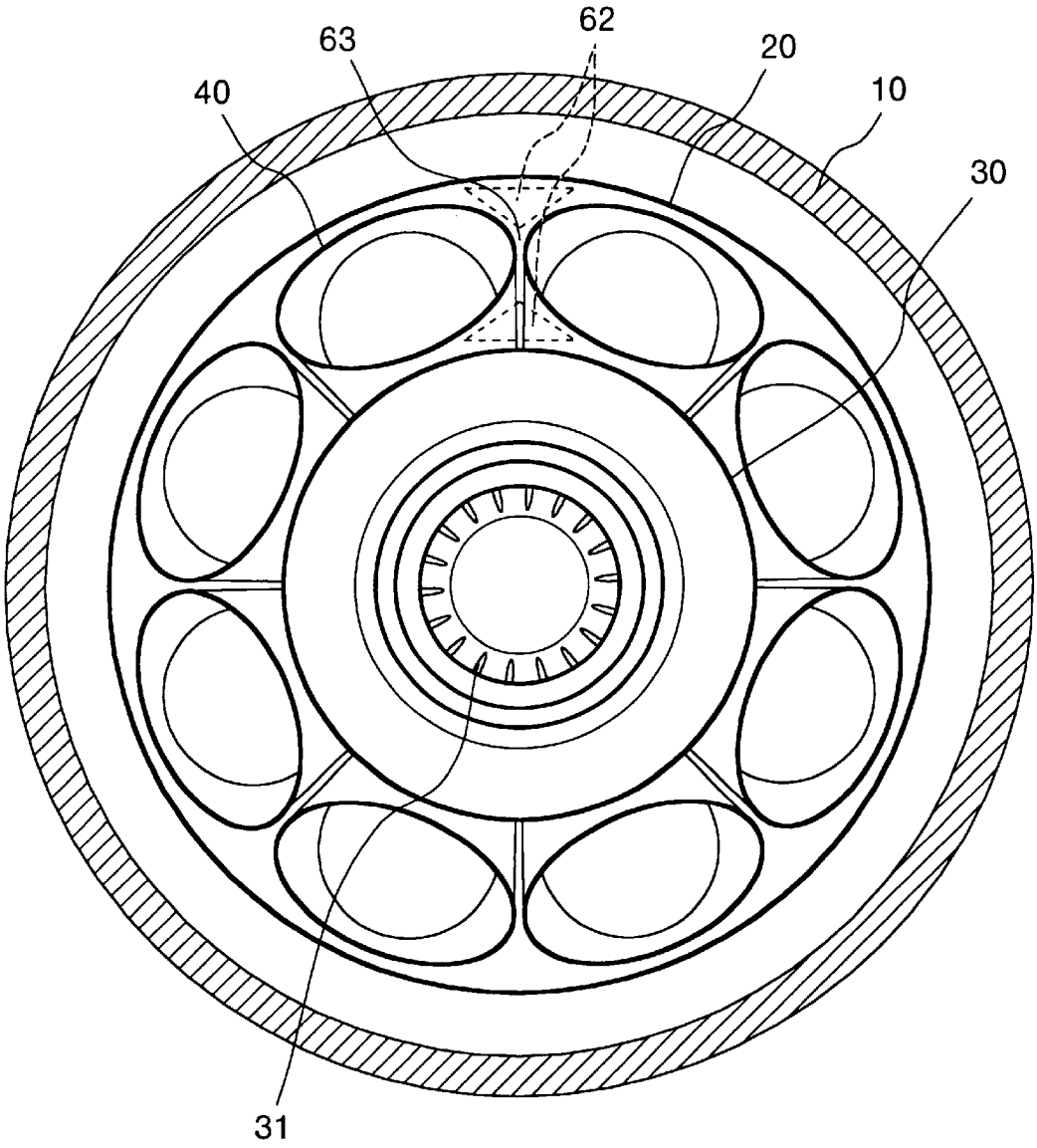
Prior Art FIG.7
FIG. 7 is a front view of a conventionally used gas turbine combustor of a multi-nozzle premix type.

On the other hand, after cooling the premixed flame-formation nozzles and the like, part of the air fed from the compressor is passed through the clearances between the premixed flame-formation nozzles 41 and the combustor inner cylinder 20 and the like and discharged toward the combustion chamber 50. In the conventional gas turbine combustor, since the outlets of the premixed flame-formation nozzles 40 are elliptic, most of the cooled air is discharged from generally rectangular spaces 62 (see FIG. 7) formed between the adjacent premixed flame-formation nozzles 40 and the spread flame formation cone 30 and between the adjacent premixed flame-formation nozzles 40 and the combustor inner cylinder 20. As a result, the flows of the cooled air passed through the generally rectangular spaces 62 and the clearances 63 between the adjacent premixed flame-formation nozzles 40 become uneven. The uneven air flows often cause the backflow of the high-temperature combustion gas discharged from the premixed flames and the combustion gas thus flowing back often burns the portions on which the premixed flame-formation nozzles 40 are adjacent each other.

According to the gas turbine combustor of the first embodiment, by contrast, the outlets of the premixed flame-formation nozzles 41 are sector-shaped and the nozzles 41 having such outlets are disposed around the spread flame formation cone 30. Unlike the conventional premixed flame-formation nozzles 40, there exist no generally rectangular spaces 62 formed between the adjacent premixed flame-formation nozzles 40 and the spread flame formation cone 30 and the like. Therefore, unlike the conventional gas turbine combustor, the flows of the cooled air do not become uneven and the cooled air can even flow into the portions between the adjacent premixed flame-formation nozzles 41, making it possible to suppress the combustion gas from flowing back to the portions between the adjacent premixed flame-formation nozzles 41. Consequently, it is possible to prevent the portions between the adjacent premixed flame-formation nozzles 41 from being burned.

Figure 2:
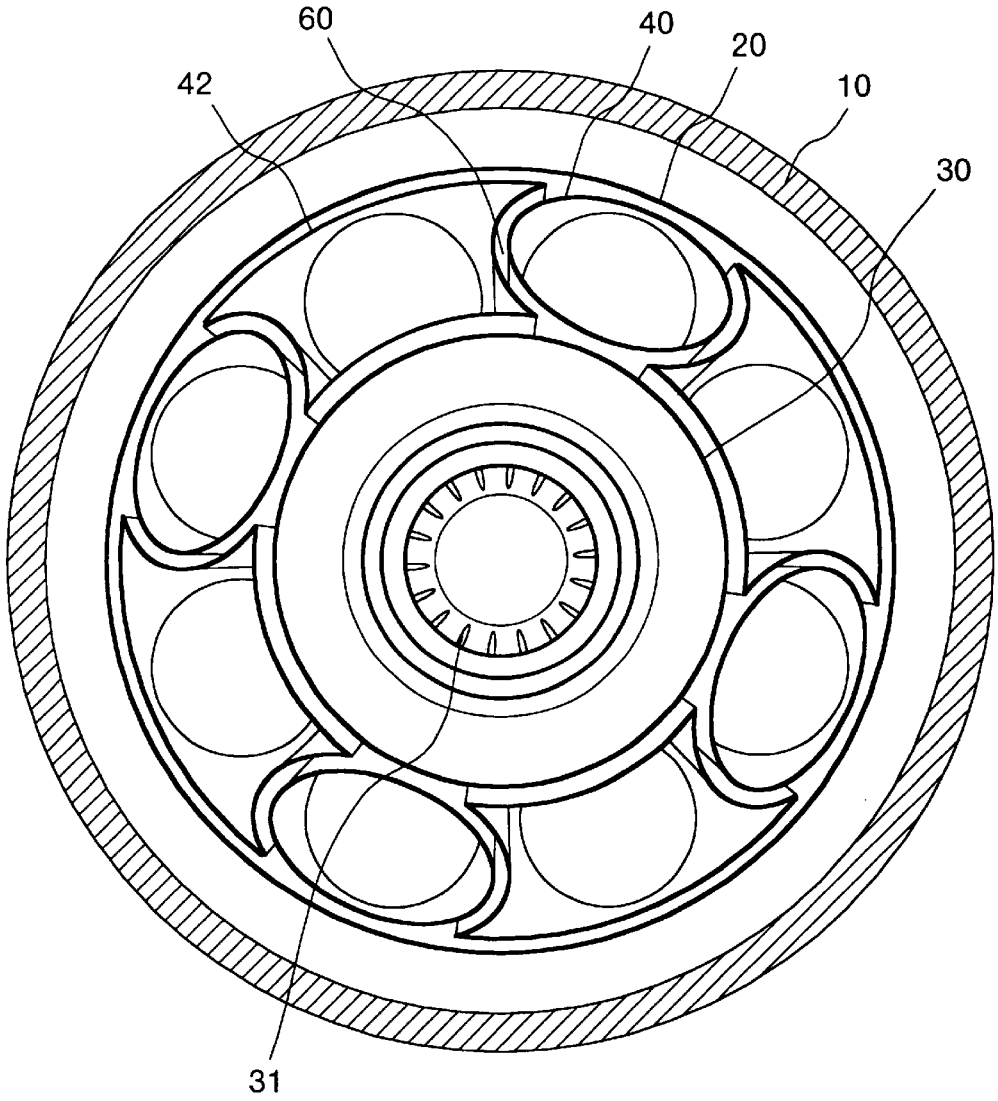
FIG. 2 is a front view of a modification of the gas turbine combustor according to the first embodiment of the invention.

FIG. 2 is a front view of a modification of the gas turbine combustor according to the first embodiment. Premixed flame-formation nozzles 40 and 42 according to this gas turbine combustor have outlets which are shaped so that the adjacent premixed flame-formation nozzles 40 and 42 are fitted into each other, thereby keeping the clearances 60 between the adjacent premixed flame-formation nozzles 40 and 42 constant.

The gas turbine combustor shown in FIG. 2 is configured in such a manner that the premixed flame-formation nozzles 40 having elliptic outlets and the premixed flame-formation nozzles 42 having generally enveloping outlets, are alternately combined and disposed annularly around a spread flame formation cone 30. A premixed flame-formation nozzle 42 is adjacent to a premixed flame-formation nozzle 40 having the elliptic outlet. In addition, the outer peripheral portion of each premixed flame-formation nozzle 42 is concave to be matched to the outer periphery of each premixed flame-formation nozzle 40. Therefore, if the premixed flame-formation nozzles 40 and 42 are alternately disposed, the clearances 60 between the nozzles 40 and 42 can be kept constant.

As stated so far, according to the gas turbine combustor of the first embodiment, since the clearances 60 between the adjacent portions are kept constant, the flows of the cooled air do not become uneven and the cooled air can flow even into the portions between the premixed flame-formation nozzles 40 and 42. As a result, it is possible to suppress combustion gas from flowing back to the clearances 60 between the adjacent premixed flame-formation nozzles 40 and 42 and to prevent the portions between the adjacent premixed flame-formation nozzles 40 and 42 from being burned.

Figure 3:
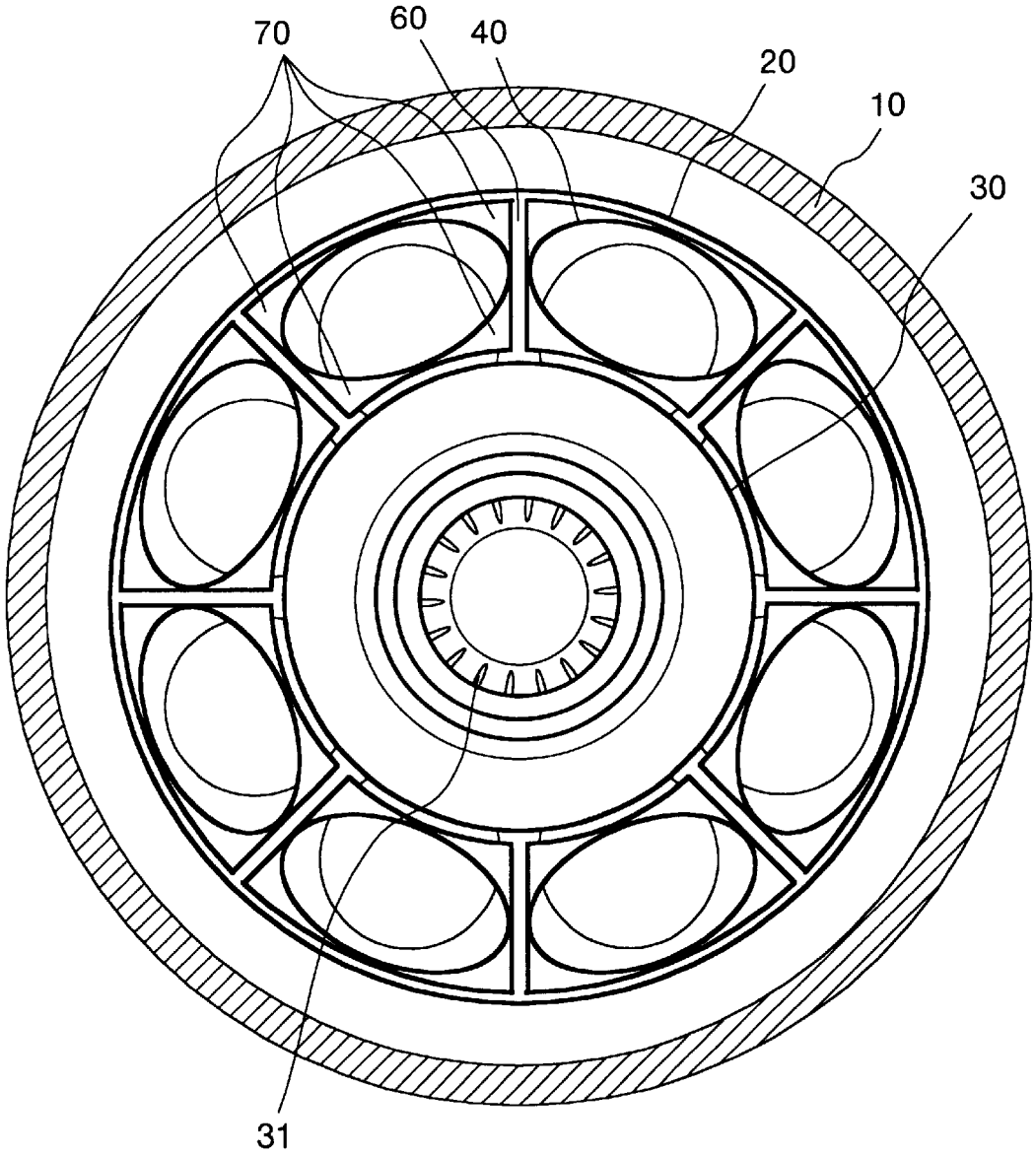
FIG. 3 is a front view of a gas turbine combustor according to a second embodiment of the invention.

FIG. 3 is a front view of the gas turbine combustor according to the second embodiment of the present invention. This gas turbine combustor provides sealing members 70 which seal the generally rectangular spaces 62 (see FIG. 7) at premixed flame-formation nozzles 40. The sealing members 70 are provided at the outlets of the premixed flame-formation nozzles 40 to be projected from the outlets of the premixed flame-formation nozzles 40. The sealing members 70 are disposed so as to keep the clearances 60 between the adjacent premixed flame-formation nozzles 40 constant.

Figure 4A:
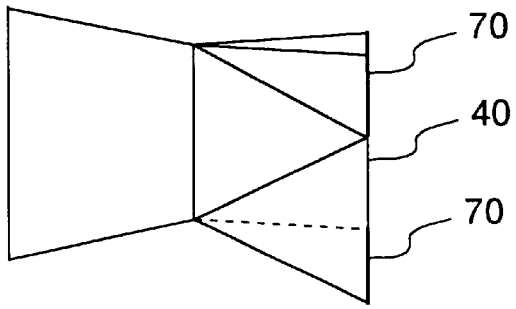
FIG. 4A is a side view and FIG. 4B is a perspective view of one example of a sealing member.
Figure 4B:
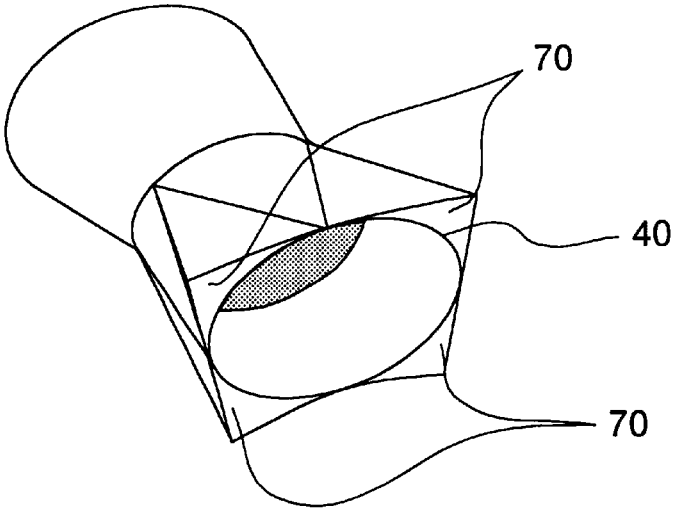

It is preferable that the sealing members 70 are formed integrally with the premixed flame-formation nozzles 40 in light of strength. Alternatively, instead of providing the sealing members 70 at all the premixed flame-formation nozzles 40, one sealing member 70 may be provided, for example, at one of the adjacent premixed flame-formation nozzles 40 and the outlet of the other premixed flame-formation nozzle 40 may be shaped to be matched to the sealing member 70. It is also possible to configure the side of each sealing member 70 against which side cooled air is struck as shown in, for example, FIG. 4A and FIG. 4B so as not to disturb the flow of the cooled air.

In the gas turbine combustor of the second embodiment, the sealing members 70 seal the generally triangular spaces 62 (see FIG. 7) existing between the adjacent premixed flame-formation nozzles 40 and the spread flame formation cone 30 and between the adjacent premixed flame-formation nozzles 40 and the combustor inner cylinder 20. At the outlets of the adjacent premixed flame-formation nozzles 40, clearances 60 of same dimensions are provided by the sealing members 70, respectively.

In the conventional gas turbine combustor, most of the cooled air flows out from the generally triangular spaces 62. However, in the gas turbine combustor of the second embodiment, the cooled air evenly flows out from the clearances 60 of the same dimensions by the sealing members 70. Therefore, the flows of the cooled air do not become uneven as seen in the conventional combustor and the cooled air flows even into the clearances 60 between the adjacent premixed flame-formation nozzles 40, making it possible to prevent combustion gas from flowing back to the clearances 60. As a result, it is possible to prevent the portions between the adjacent premixed flame-formation nozzles 40 from being burned.

Figure 5:
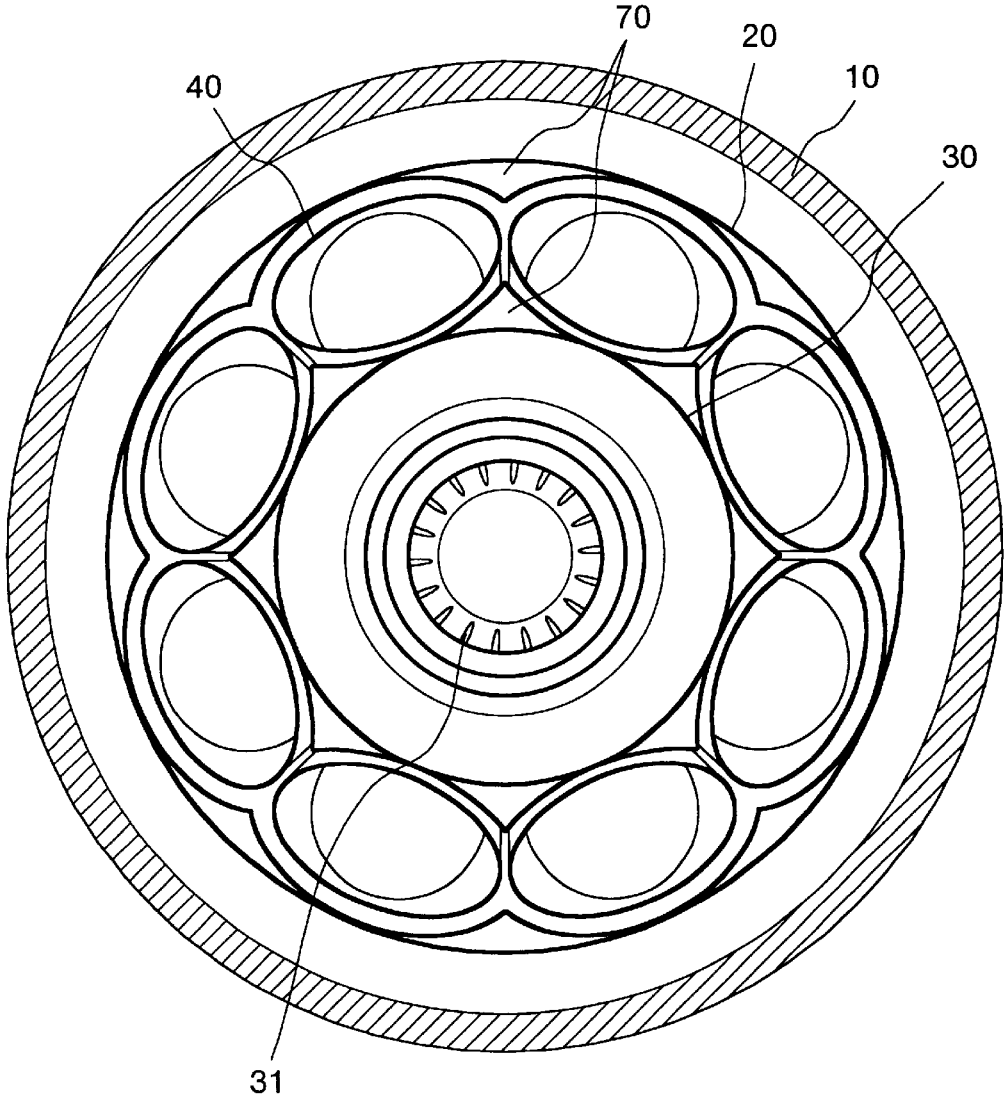
FIG. 5 is a front view of a gas turbine combustor according to a third embodiment of the invention.

FIG. 5 is a front view of the gas turbine combustor according to the third embodiment of the present invention. This gas turbine combustor provides sealing members 70 having angle cross sections which seal the generally rectangular spaces 62 (see FIG. 7) at a combustor inner cylinder 20 and a spread flame formation cone 30, respectively. The sealing members 70 each having an angle cross section in a front view are provided on the peripheral portions of the combustor inner cylinder 20 and the spread flame formation cone 30, respectively. It is preferable that the sealing members 70 are formed integrally with the combustor inner cylinder 20 and the spread flame formation cone 30, respectively in view of strength. It is noted that the side of each sealing member 70 against which side cooled air is struck can be configured to prevent the flows of the cooled air from being disturbed as stated above.

In the gas turbine combustor of the third embodiment, the sealing members 70 seal the generally triangular spaces 62 (see FIG. 7) existing between adjacent premixed flame-formation nozzles 40 and the spread flame formation cone 30 and between the adjacent premixed flame-formation nozzles 40 and the combustor inner cylinder 20. Clearances of same dimensions are provided between the premixed flame-formation nozzles 40 and the sealing members 70. In the case of the conventional premixed flame-formation nozzles, most of the cooled air flows out from the generally triangular spaces 62. In this gas turbine combustor, the cooled air evenly flows out from the peripheries of the premixed flame-formation nozzles 40. The flows of the cooled air do not, therefore, become uneven and the cooled air flows even to the portions between the premixed flame-formation nozzles 40, making it possible to prevent combustion gas from flowing back to the portions between the adjacent premixed flame-formation nozzles 40. As a result, it is possible to prevent the portions between the adjacent premixed flame-formation nozzles 40 from being burned.

Figure 6:
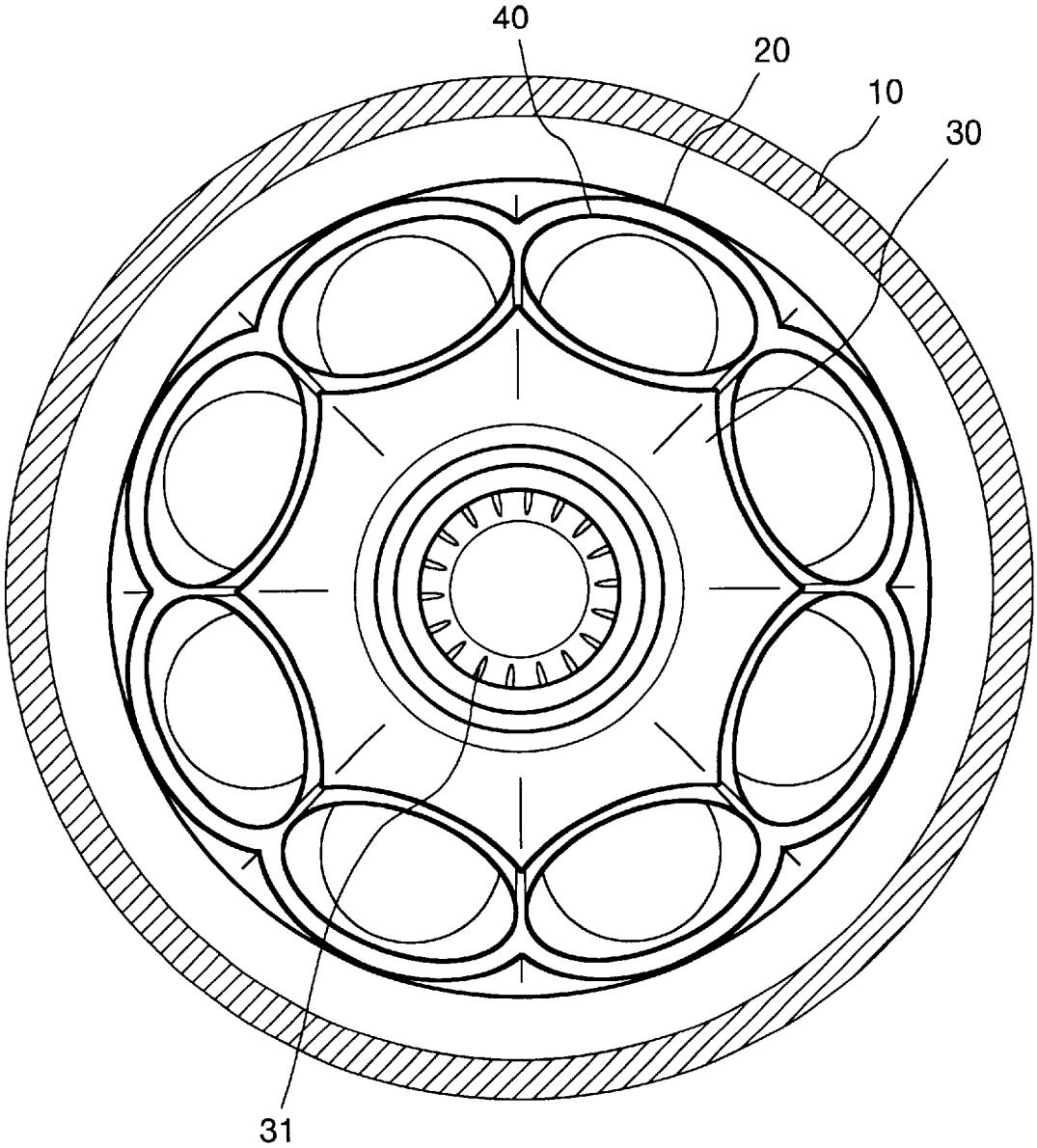
FIG. 6 is a front view of a gas turbine combustor according to a fourth embodiment of the invention.

FIG. 6 is a front view of the gas turbine combustor according to the fourth embodiment of the present invention. This gas turbine combustor makes the internal shape of a combustor inner cylinder 20 and the outer shape of a spread flame formation cone 30 matched to the outer shape of a group of premixed flame-formation nozzles 40 with clearances of a certain size kept therebetween. As shown in FIG. 6, the outer periphery of the combustor inner cylinder 20 and that of the spread flame formation cone 30 are curved in a corrugated fashion along the annular outer periphery of the group of the premixed flame-formation nozzles 40 each having an elliptic cross section. In case of the conventional premixed flame-formation nozzles, most of the cooled air flows out from the generally rectangular spaces 62 (see FIG. 7). In case of the nozzles of this gas turbine combustor, the cooled air flows out from the entire peripheries of the premixed flame-formation nozzles 40.

Therefore, the uneven flows of the cooled air do not occur unlike the conventional gas turbine combustor and the cooled air sufficiently flows into the portions between the adjacent premixed flame-formation nozzles 40, making it possible to suppress combustion gas from flowing back to the portions between the adjacent premixed flame-formation nozzles 40. As a result, it is possible to prevent the portions between the adjacent premixed flame-formation nozzles 40 from being burned. It is preferable that the clearances between the adjacent premixed flame-formation nozzles 40, those between the premixed flame-formation nozzles 40 and the combustor inner cylinder 20 and those between the premixed flame-formation nozzles 40 and the spread flame formation cone 30 are set almost equal, respectively. By doing so, the cooled air flows out from the peripheries of the premixed flame-formation nozzles 40 further evenly, making it possible to prevent the backflow of the combustion gas more effectively.

As stated so far, according to the gas turbine combustor of one aspect of the present invention, nozzle outlets of the premixed flame-formation nozzles are shaped so that clearances between outer peripheries of the premixed flame-formation nozzles adjacent each other have same dimensions at the nozzle outlets. Therefore, the air flows even into the portions between the adjacent premixed flame-formation nozzles and the backflow of combustion gas to the portions between the adjacent premixed flame-formation nozzles can be prevented. As a result, it is possible to prevent the portions between the adjacent premixed flame-formation nozzles from being burned.

Moreover, the clearances between the outer peripheries of the premixed flame-formation nozzles are generally linear at the nozzle outlets. Therefore, it is possible to prevent the portions between the adjacent premixed flame-formation nozzles from being burned and to relatively facilitate the manufacturing of the premixed flame-formation nozzles.

Furthermore, at least either clearances between outer peripheries of the nozzle outlets of the premixed flame-formation nozzles and an inner periphery of an outlet of the combustor inner cylinder or clearances between the outer peripheries of the nozzle outlets of the premixed flame-formation nozzles and an outer periphery of an outlet of the spread flame formation cone are set to be constant. Therefore, the cooled air can flow evenly into more regions on the outer peripheries of the outlets of the premixed flame-formation nozzles and it is possible to prevent more effectively the portions between the adjacent premixed flame-formation nozzles from being burned.

According to the gas turbine combustor of another aspect of the present invention, sealing members which are provided between the premixed flame-formation nozzles adjacent each other, respectively make the clearances between the premixed flame-formation nozzles adjacent each other have same dimensions at nozzle outlets. Therefore, the cooled air flows even into the portions between the adjacent premixed flame-formation nozzles, thereby making it possible to suppress the backflow of combustion gas into these portions and to prevent the portions between the adjacent premixed flame-formation nozzles from being burned.

According to the gas turbine combustor of still another aspect of the present invention, sealing members, each having an angle cross section, are disposed in generally triangular spaces formed between the adjacent premixed flame-formation nozzles and the spread flame formation cone and between the adjacent premixed flame-formation nozzles and the combustor inner cylinder while forming clearances of same dimensions between the sealing member and outer peripheries of the outlets of the premixed flame-formation nozzles, respectively. These sealing members eliminate the generally triangular spaces formed between the adjacent premixed flame-formation nozzles and the spread flame formation cone and between the adjacent premixed flame-formation nozzles and the combustor inner cylinder. Therefore, the cooled air flows even into the portions between the adjacent premixed flame-formation nozzles. As a result, it is possible to suppress the backflow of combustion gas into the portions between the adjacent premixed flame-formation nozzles. Consequently, it is possible to prevent the portions between the adjacent premixed flame-formation nozzles from being burned.

According to the gas turbine combustor of still another aspect of the present invention, the inside of the combustor inner cylinder and the outside of the spread flame formation cone are shaped to be matched to the outer shape of the annular premixed flame-formation nozzle groups with same dimensions, respectively. Therefore, the cooled air evenly flows into the peripheries of the premixed flame-formation nozzles and it is possible to thereby suppress the back flow of combustion gas in the direction of the adjacent premixed flame-formation nozzles. As a result, it is possible to prevent the portions between the adjacent premixed flame-formation nozzles from being burned.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A gas turbine combustor comprising:

a combustor inner cylinder;

a spread flame formation cone, disposed inside said combustor inner cylinder, which forms spread flames by mixing pilot fuel with air; and a plurality of premixed flame-formation nozzles which form premixed flames out of premixed gas formed by mixing main fuel with the air and which are disposed annularly between said combustor inner cylinder and said spread flame formation cone, wherein, nozzle outlets of said premixed flame-formation nozzles are shaped so that clearances between outer peripheries of said premixed flame-formation nozzles adjacent each other have same dimension at said nozzle outlets, wherein the clearances between the outer peripheries of said premixed flame-formation nozzles are generally linear at said nozzle outlets.

2. The gas turbine combustor according to claim 1, wherein one or more of the clearances between outer peripheries of said nozzle outlets of said premixed flame-formation nozzles and an inner periphery of an outlet of said combustor inner cylinder, and the clearances between the outer peripheries of said nozzle outlets of said premixed flame-formation nozzles and an outer periphery of an outlet of said spread flame formation cone have same dimensions.

* * * * *